US005119621A

United States Patent [19]

Inger

[11] Patent Number: 5,119,621

[45] Date of Patent: Jun. 9, 1992

[54] MAINTENANCE DEVICE FOR EXCHANGING YARN SUPPLY PACKAGES AT SPINDLE ASSEMBLY STATIONS OF A YARN PROCESSING MACHINE

[75] Inventor: Siegfried Inger, Tönisvorst, Fed. Rep. of Germany

[73] Assignee: Palitex Project Company GmbH, Krefeld, Fed. Rep. of Germany

[21] Appl. No.: 549,762

[22] Filed: Jul. 9, 1990

[30] Foreign Application Priority Data

Jul. 24, 1989 [EP] European Pat. Off. ..... 89113551

[51] Int. Cl.[5] ..... D01H 9/18; D01H 9/8

[52] U.S. Cl. ..... 57/281; 57/270; 57/271; 57/275

[58] Field of Search ..... 57/270, 271, 275, 281, 57/304, 305

[56] References Cited

U.S. PATENT DOCUMENTS

| | | | |
|---|---|---|---|
| 3,370,412 | 2/1968 | Franzen et al. | 57/270 |
| 3,935,699 | 2/1976 | Iida et al. | 57/270 X |
| 4,759,175 | 7/1988 | Inoue | 57/58.83 X |
| 4,805,352 | 2/1989 | Grassle et al. | 57/270 X |
| 4,897,992 | 2/1990 | Kogiso et al. | 57/281 |
| 4,899,530 | 2/1990 | Morrison | 57/266 X |
| 4,979,360 | 12/1990 | Kallmann et al. | 57/268 X |

FOREIGN PATENT DOCUMENTS

| | | |
|---|---|---|
| 2811128 | 12/1978 | Fed. Rep. of Germany . |
| 3824998 | 2/1989 | Fed. Rep. of Germany . |

*Primary Examiner*—Daniel P. Stodola
*Assistant Examiner*—William Stryjewski
*Attorney, Agent, or Firm*—Bell, Seltzer, Park & Gibson

[57] ABSTRACT

A maintenance device is provided in a two-for-one twister textile yarn processing machine having a plurality of spindle assembly stations in side-by-side relationship along the length of the machine for processing of yarn at each station as the yarn is fed from yarn supply packages carried by an adapter device and mounted in the spindle assembly, and an overhead conveyor mechanism extending the length of the machine generally above the spindle assembly stations and including spaced-apart downwardly-directed suspension holders for releasably receiving and carrying adapter devices with full yarn supply packages thereon and adapter devices with substantially empty yarn supply packages thereon to and from respective spindle assembly stations. The maintenance device is constructed for traveling to a respective spindle assembly station, removing an adapter device with substantially empty yarn supply packages from the respective spindle assembly and positioning such adapter device on the conveyor mechanism, and synchronously removing an adapter device with full yarn supply packages from the conveyor mechanism and positioning such adapter device in the respective spindle assembly.

7 Claims, 6 Drawing Sheets

MAINTENANCE DEVICE FOR EXCHANGING YARN SUPPLY PACKAGES AT SPINDLE ASSEMBLY STATIONS OF A YARN PROCESSING MACHINE

FIELD, BACKGROUND AND OBJECTS

This invention relates to a maintenance device utilized in a two-for-one twister textile yarn processing machine having a plurality of spindle assembly stations in side-by-side relationship along the length of the machine for processing of yarn at each station as the yarn is fed from yarn supply packages carried by an adapter device and mounted in the spindle assembly, and an overhead conveyor mechanism extending the length of the machine generally above the spindle assembly stations and including spaced-apart downwardly-directed suspension holders for releasable receiving and carrying adapter devices with full yarn supply packages thereon and adapter devices with substantially empty yarn supply packages thereon to and from respective spindle assembly stations. The maintenance device is constructed for traveling to a respective spindle assembly station, removing an adapter device with substantially empty yarn supply packages from the respective spindle assembly and positioning such adapter on the conveyor mechanism, and synchronously removing an adapter device with full yarn supply packages from the conveyor mechanism and positioning such adapter device in the respective spindle assembly.

This servicing and handling is to be carried out by a largely automated apparatus, so as to be able to bridge over the relatively large horizontal and vertical spacings between an individual twisting position and a feed device constructed as an overhead conveyor for adapters equipped with fully wound feed yarn packages, with an insignificant amount of time and power consumption. According to the invention, it is essential to see that the individual steps of the operation are carried out during the exchange of tubes and packages as parallel in time as possible, i.e. synchronously.

In accordance with this invention, the maintenance device for traveling to a respective spindle assembly station of the textile yarn processing machine, removing an adapter device with substantially empty yarn supply packages from the respective spindle assembly and positioning such adapter device on the conveyor mechanism and synchronously removing an adapter device with full yarn supply packages from the conveyor mechanism and positioning such adapter device in the respective spindle assembly includes generally the following.

A housing is mounted for movement longitudinally along the textile yarn processing machine to each of the spindle assembly stations. A first gripper means is mounted in the housing for upward, downward and pivoting horizontal movement for moving out of the housing and gripping the adapter device in a spindle assembly at a selected station and moving and depositing such adapter device in the maintenance device, and for gripping an adapter device with full yarn packages in the maintenance device and moving and depositing such adapter device in the selected spindle assembly. Mandrel means including two horizontally-spaced upwardly-extending mandrels are each mounted in the housing for upward, downward and pivoting horizontal movement for receiving and supporting the adapter device with substantially empty yarn packages from the gripper means on one of the mandrels positioned within the housing and for pivoting outside of the housing and moving upwardly to deposit such adapter device on one of the suspension holders of the conveyor mechanism and returning to the position within the housing, and for receiving and supporting an adapter device with full yarn packages from a suspension holder of a conveyor mechanism on the other of the mandrels after pivoting out of the housing and moving upward to the conveyor mechanism and returning to a position within the housing for gripping of the adapter device with full yarn packages by the gripper means.

With this construction of a maintenance device, the mandrel means is adapted to move to the conveyor means, retrieve and carry an adapter device with full yarn packages thereon down and into the maintenance device while the gripper means is removing an adapter device with substantially empty yarn packages from the spindle assembly and placing such adapter device on a second mandrel in the maintenance device, so that the gripper may then grip the adapter device with full yarn packages thereon to place such adapter device in the spindle assembly, while the mandrel means is carrying the adapter device with substantially empty yarn packages thereon out of the maintenance device and to the conveyor mechanism for deposit thereon. All of these operations are carried out in synchronism for saving time of operation for the yarn package exchange by the maintenance device at the selected spindle assembly station.

Preferably, the adapter device for carrying yarn supply packages includes a lower yarn package carrying part and an upper head piece part releasably and axially connected to each other. For third type of adapter device, the maintenance device further includes a second gripper means mounted in the housing for upward, downward and pivoting horizontal movement for moving out of the housing and gripping the upper part of the adapter device and removing the upper part of the adapter device so that the lower part of the adapter device with substantially empty yarn packages thereon may be gripped and moved by the first gripper means and for repositioning the upper part of the adapter device into the lower part of an adapter device with full yarn packages thereon after such lower part has been positioned in the spindle assembly by the first gripper means.

Preferably, the mandrel means further includes a head device mounted for rotation about a horizontal axis in the housing, motor means for selectively driving the rotary head device, two separate arms each mounting one of the mandrels on the other end thereof and being releasably carried by the rotary head device at their inner ends for rotation of the mandrels therewith out of and into the housing, and lifting means positioned for engaging one of the arms when the arm positions the mandrel carried thereby outside of the housing for upward and downward movement of such arm and mandrel. The lifting means may also include a vertical rail, a tow carriage device having track rolls thereon for moving up and down the rail, and a driven belt attached to the tow carriage device and extending generally parallel along the length of the vertical rail. Each of the mandrel carrying arms and the tow carriage device preferably include complimentary coupling elements, in the form of an undercut in the two carriage device and a claw on each of the arms, so as to detachably couple one of the arms with the two carriage device when rotated to position the mandrel carried thereby outside of the housing.

The lifting means preferably includes drive means for the belt in the form of a fluid-operated piston and cylinder mechanism, a plate connected to the piston and cylinder mechanism for movement thereby in an upward and downward direction, two rotatably deflecting pulleys mounted on the plate for receiving opposite ends of the belt looped there around in the form of a tackle, the ends of the belt being secured stationary on the housing so that upward and downward movement of the plate by the piston and cylinder causes movement of the belt to effect upward and downward movement of the two carriage device. Preferably, the belt is a toothed belt and the lifting means further includes pinion rolls over which the belt is mounted for guiding of the belt. The lifting means may further include dampening means associated with the piston and cylinder mechanism and the plate for a resilient braking of the movement of the plate and thus the belt.

The rotary head device is preferably provided with diametrically-opposed vertically-extending guide rail sections and each of the mandrel carrying arms includes track rolls thereon for mounting of the arms on the rotary head device. The guide rail sections and the vertical rail are complimentary so that each of the arms may move in a vertical direction from the guide rail section to the vertical rail and up the vertical rail when lifted by the tow carriage of the lifting means.

BRIEF DESCRIPTION OF THE DRAWINGS

The invention will be described below in greater detail with reference to the drawing, in which.

DETAILED DESCRIPTION OF THE PREFERRED EMBODIMENT OF THIS INVENTION

Figure 1:
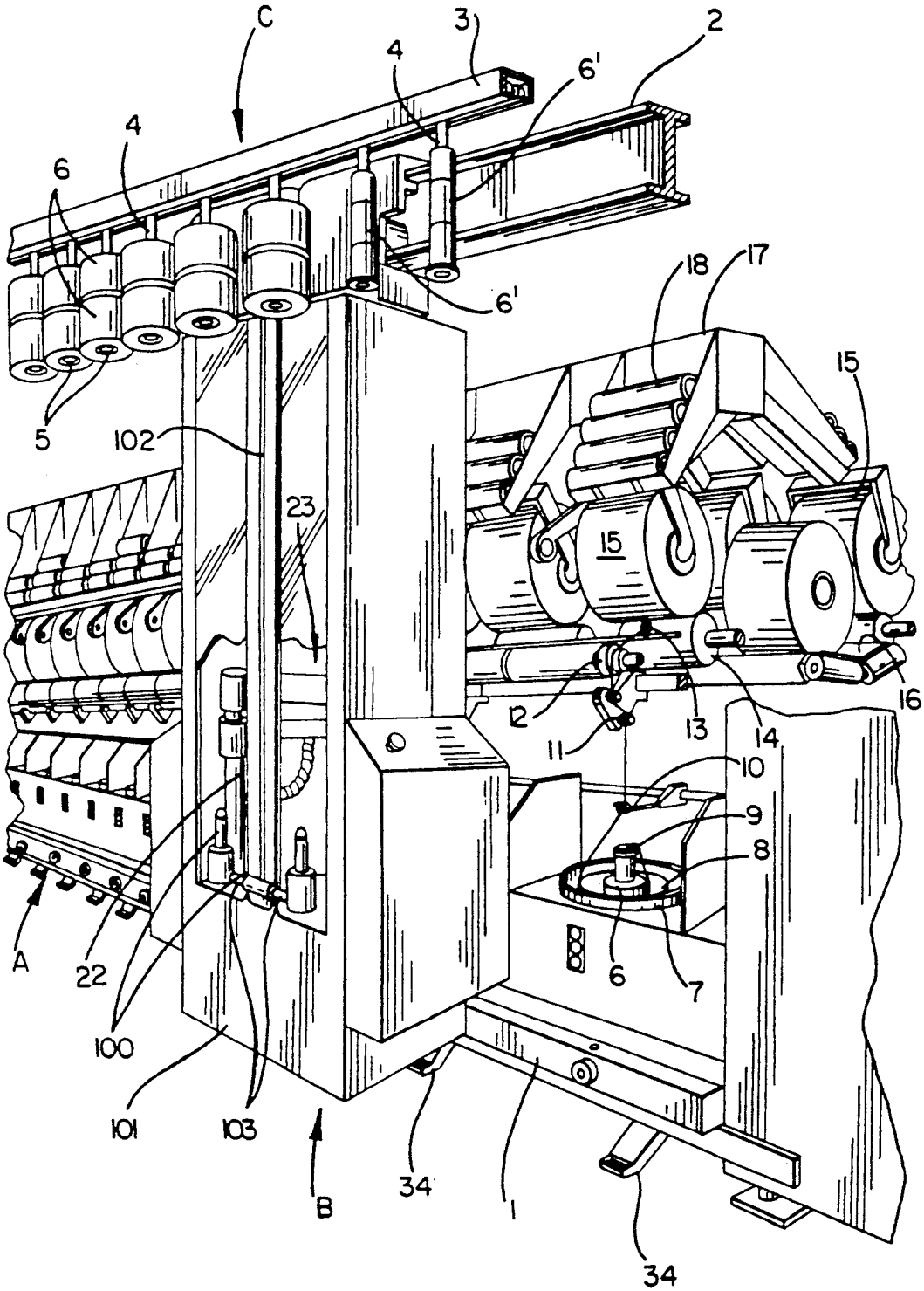
FIG. 1 is a perspective view of a portion of a two-for-one twister with an automatic maintenance device traveling along this machine.

FIG. 1 illustrates a portion of a two-for-one twister A, an automatic maintenance device B traveling along the two-for-one twister on lower and upper rails 1 and 2, as well as an overhead conveyor C.

The overhead conveyor C comprises an upper rail 3, along which a conveyor chain or belt extends with evenly spaced-apart, downward directed suspension holders 4 attached thereto for accommodating package adapters or package transport adapters 5. The suspension holders 4 and package adapters 5 are constructed in known manner, so that during a first upward movement of a package adapter 5, the latter is grasped and held by the suspension holder 4, and released therefrom during a second upward movement and subsequent lowering relative to the suspension holder 4. FIG. 1 shows in the region of the upper rail 3, on the left side, six package adapters 5, each loaded with two fully cross-wound packages or feed yarn packages 6, which are to be delivered by the automatic maintenance device B to the individual twisting positions of the two-for-one twister A, and on the right side, two package adapters 5, each holding two empty tubes 6,' which were individually removed by the automatic maintenance device B from the twisting positions of the two-for-one twister A and delivered to a suspension holder 4. These tubes 6, which may still carry some residual yarn are transported together with the package and transport adapters 5 by means of the overhead conveyor C to an external loading station, where the adapters 5 can again receive fully wound feed yarn packages or cross-wound packages 6. The feed yarn packages can also be assembly wound yarn packages.

The two-for-one twister A comprises a plurality of working or twisting positions with the known standard elements, such as a spindle (not shown) in the lower portion, balloon limiter 7, protective spindle pot 8, yarn inlet end 9, balloon yarn guide 10, deflecting elements 11 for controlling the yarn winding tension, overfeed element 12, traversing yarn guide 13, and a cross-wound package of the twisted yarn or takeup package 15 driven by a friction roll 14. In the center of the machine, a conveyor belt 16 extends in the upper region between the two parallel machine sides for the removal of fully wound packages 15 of the twisted yarn. Located above each Cross-wound package or takeup package 15 of the twisted yarn, which is driven by friction roll 14, is a magazine 17 for empty takeup tubes 18.

Shown inside the protective pot 8 is an upper, only partially cross-wound package or feed yarn package 6 of a pair of feed yarn packages, which are inserted by means of a package adapter 5 into the twisting position. From the feed yarn packages, the yarns are withdrawn upward and guided through the yarn inlet end 9 into the lower spindle portion to a yarn storage disk, whence the two combined yarns advance to a balloon yarn guide 10 while forming a yarn balloon, and subsequently, after passing deflection rolls 11 and overfeed roll 12 onto to a takeup package 15 driven by friction roll 14.

The automatic maintenance device B routinely travels in front of the two-for-one twister A or its individual twisting positions respectively. FIG. 1 shows a schematic detail view of the different handling elements of the automat B, which serve to exchange a package adapter 5 loaded with empty tubes 6' (unwound unit) for a package adapter 5 loaded with full crosswound packages 6 (feed yarn unit), and to manipulate or secure the yarns ends of the empty or respectively almost unwound wound tubes 6, These handling elements comprise primarily two mandrels 100, which are adapted to rotate about a vertical axis and to move upward and downward in vertical direction to receive feed yarn units and unwound units, as well as gripping and suction means 22 and 23.

The automatic maintenance device B comprises a cabinet-shaped housing 101, whose front wall is provided with a guide rail 102 for a rotatable cross arm 103 which carries a mandrel 100.

The following will describe both the constructional details and the steps of the method according to the present invention as well as the functions of the individual elements of the present invention.

Figure 2:
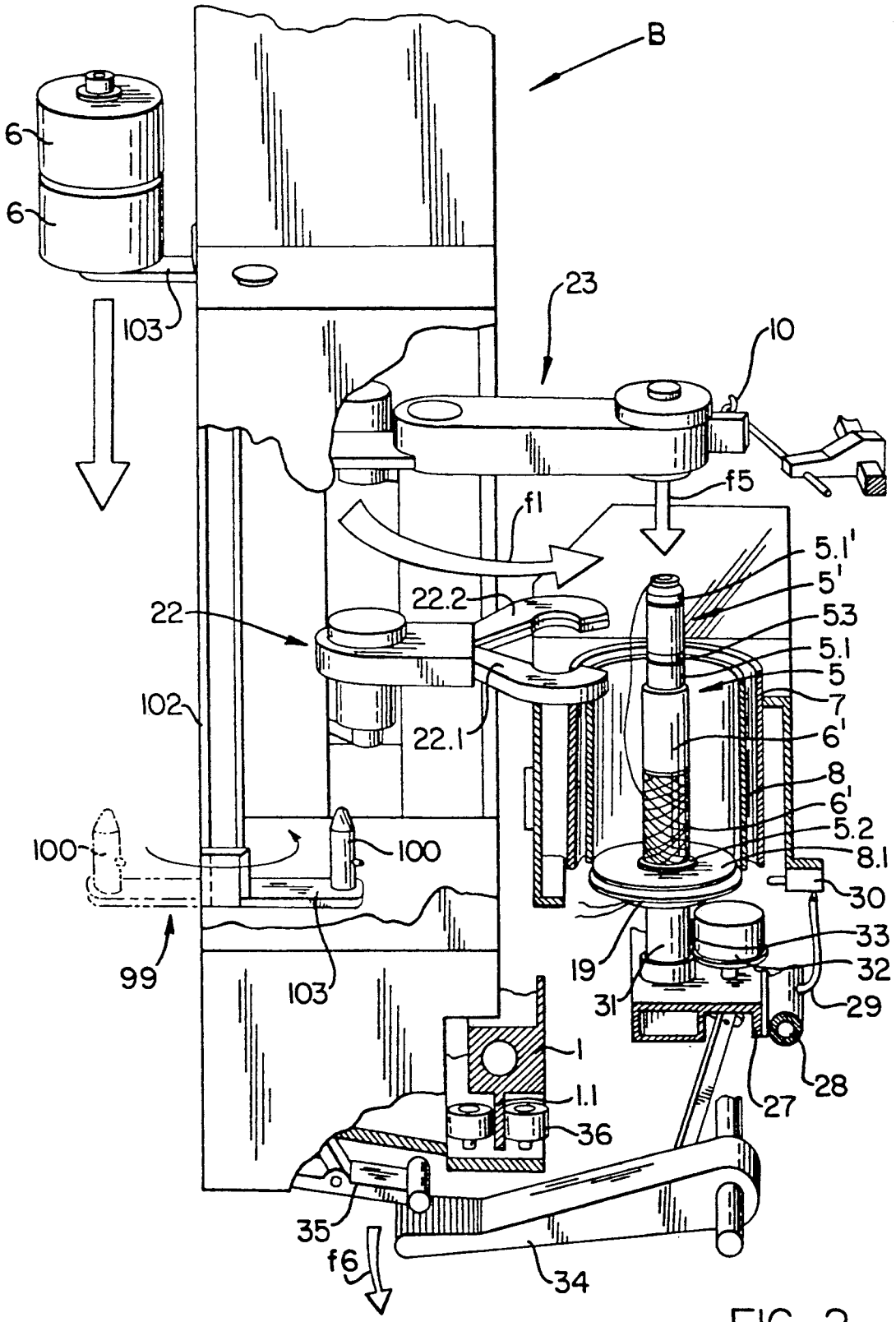
FIG. 2 is a partially sectional, partially perspective view of a two-for-one twisting spindle with an automatic maintenance device and servicing and handling elements, associated therewith.

FIG. 2 illustrates in addition the bottom 8.1 of the protective pot of a two-for-one twisting spindle as well as the usual yarn storage disk 19. The package adapter 5 which, as was described above, is simultaneously also the transport adapter, comprises a cylindrical portion 5.1, which is provided with a carrying flange 5.2 at its lower end and, preferably, with an annular groove 5.3 in the region of its upper end. A gripper 22 of the automatic maintenance device B, which is provided with two arms 22.1 and 22.2 and adapted to rotate in horizontal direction (arrow fl) and to move upward and downward, serves to remove an unwound unit from the two-for-one twisting spindle. The ends of the gripper arms 22.1 and 22.2 are able to tightly embrace the package adapter 5, which is inserted into the protective pot 8 of the spindle, on its outer circumference, preferably however, in the region of its annular groove 5.3, thereby automatically clamping and securing the yarn end advancing from the lower tube 6' not yet fully unwound and entering into the hollow shaft of the package adapter. When removing the package adapter 5 from the protective pot s by the upward movement of the gripper 22, it is necessary to see to it that the yarn end can be pulled out unobstructed from the hollow shaft of the spindle by the automatic opening of a yarn brake, which is arranged in known manner inside the hollow shaft of the two-for-one twisting spindle.

Figure 3:
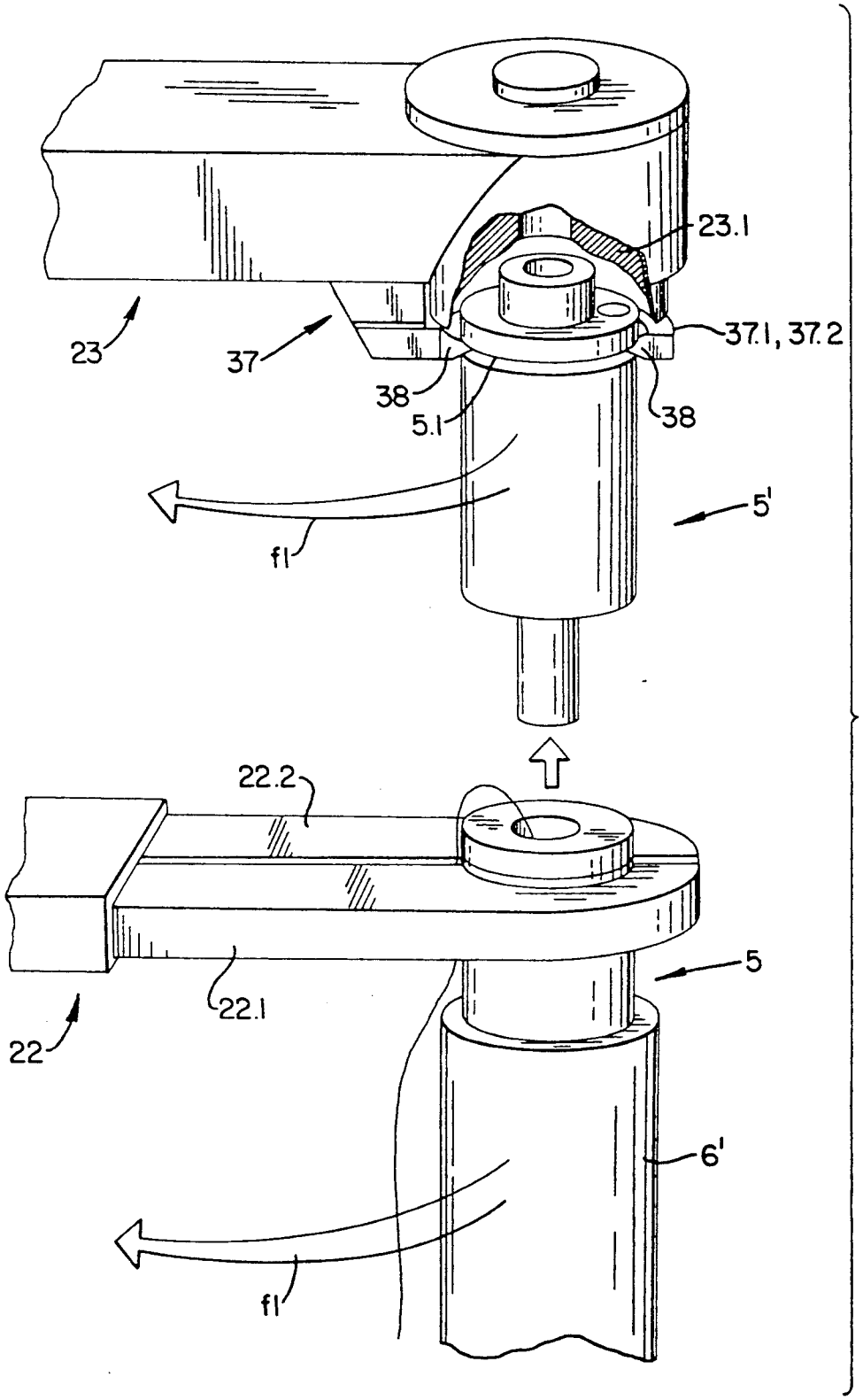
FIG. 3 is a schematic, perspective view of details of a lower gripper and an upper gripper likewise provided with a suction device.

As is shown in FIGS. 2 and 3, the description proceeds from a bipartite package adapter. The lower portion of the adapter is a transport means for the fully wound packages or the unwound tubes respectively. In this form, the adapter is also a part of a package transport system superposed on the two-for-one twister. In the two-for-one twisting spindle, i.e. inside its protective pot, such a lower adapter portion 5 serves at the same time to center the packages on the hub of the protective pot.

Inserted on this lower adapter portion 5 is a head piece or upper adapter portion 5' comprising a hollow shaft, which serves in known manner to produce different unwinding conditions of the yarn on a two-for-one twisting spindle. For example, the upper adapter portion 5, may be a lubricating head of a known type, which forms a yarn inlet head and serves to moisten the yarn passing therethrough with a finishing agent. FIG. 2 is a cross-sectional view of a portion of the two-for-one twister and shows a machine frame 27, a compressed-air line 28 with a connection 29 leading to a two-for-one twisting spindle, which extends to a compressed-air nozzle 30 for a pneumatic yarn threadup, and a spindle whorl 31 with a belt pressure roll 32 for pressing a tangential belt 33 against the spindle whorl 31. A foot pedal 34 associated to each individual spindle serves to actuate both a spindle brake not shown and the compressed-air nozzle 30, so as to build up in known manner a suction air current in the hollow spindle for the purpose of threading the yarn through the spindle.

FIG. 2 also shows portions of the automatic maintenance device B patrolling in front the two-for-one twister on rails 1 and 2. These portions include detail views of the servicing and handling elements relevant for the invention and/or the further description, such as the gripper 22 and suction device 23, as well as an actuation lever 35, which, when being depressed in direction of arrow f6 at a given moment, allows to actuate the pedal 34 for a shutdown of individual spindles. FIG. 2 illustrates shortly above the pedal 34 two track rolls 36 of the automatic maintenance device B, which are guided along a surface 1.1 of the lower rail 1.

The suction device 23 as well as the gripper 22 are adapted to rotate in direction of arrow f1 and to vertically move upward and downward in direction of arrow f5.

As to FIG. 2, mention should also be made that once the suction device 23 is swung into the region of the spindle axis, the balloon yarn guide 10 is swung out of its coaxial position with the spindle.

FIG. 3 illustrates the gripper 22 as it grasps with its arms 22.1 and 22.2 the lower adapter portion 5, thereby clamping simultaneously the yarn extending to the tube 6' still holding a residual wind of yarn.

The upper adapter portion 5' is held in position by an upper gripper 37, which is arranged on the suction device 23 and has two arms 37.1 and 37.2 rotatable in the horizontal direction. While the two arms 22.1 and 22.2 of the lower gripper 22 are in a position to come to lie with their entire inner circumference against the outer circumference of the lower adapter portion 5 or annular groove 5.3 respectively, so that a yarn end is clamped irrespective of its position on the circumference relative to the lower adapter portion, the arms 37.1 and 37.2 of the upper gripper 37 are provided with inwardly directed projections or noses 38, which engage in point contact with an annular groove 5.1' of the upper adapter portion or yarn inlet head 5', without clamping a yarn guided along the outside of the upper adapter portion 5'.

Integrated into the lower gripper 22 or respectively its arms 22.1 and 22.2 as well as in suction device 23 are air channels, Which are not subject matter of the present invention, and through which compressed air can be supplied for a pneumatic actuation of either the gripper arms or a cutting device not shown, or in which a suction air current can be built up, so as to remove cut yarn ends. For the present invention, it is material to clamp in the region of the lower adapter portion 5 the yarn end extending to a residual yarn wind on one of the two tubes 6' by means of the arms 22.1, 22.2 of the lower gripper 22 in the manner shown in FIG. 3.

Once the condition shown in FIG. 3 is reached, the suction device 23 is pivoted sideways together with the upper gripper 37. Thereafter, it is possible to lift the lower adapter portion 5 together with the two tubes 6' out of the protective pot 8 by means of gripper 22. The gripper 22 then retracts into the automatic maintenance device B so far that the lower adapter portion 5 with the two tubes 6' can be inserted on one of the two receiving mandrels 100, which has moved to a corresponding rotated position.

Aside from the lower yarn gripper 22 and the suction device 23, FIG. 2 shows, in part in an upper and in part in a lower lifting position, a swivel and lifting device 99 of the present invention, which exchanges package or transport adapters equipped with empty tubes for package adapters holding full feed yarn packages.

Figure 4:
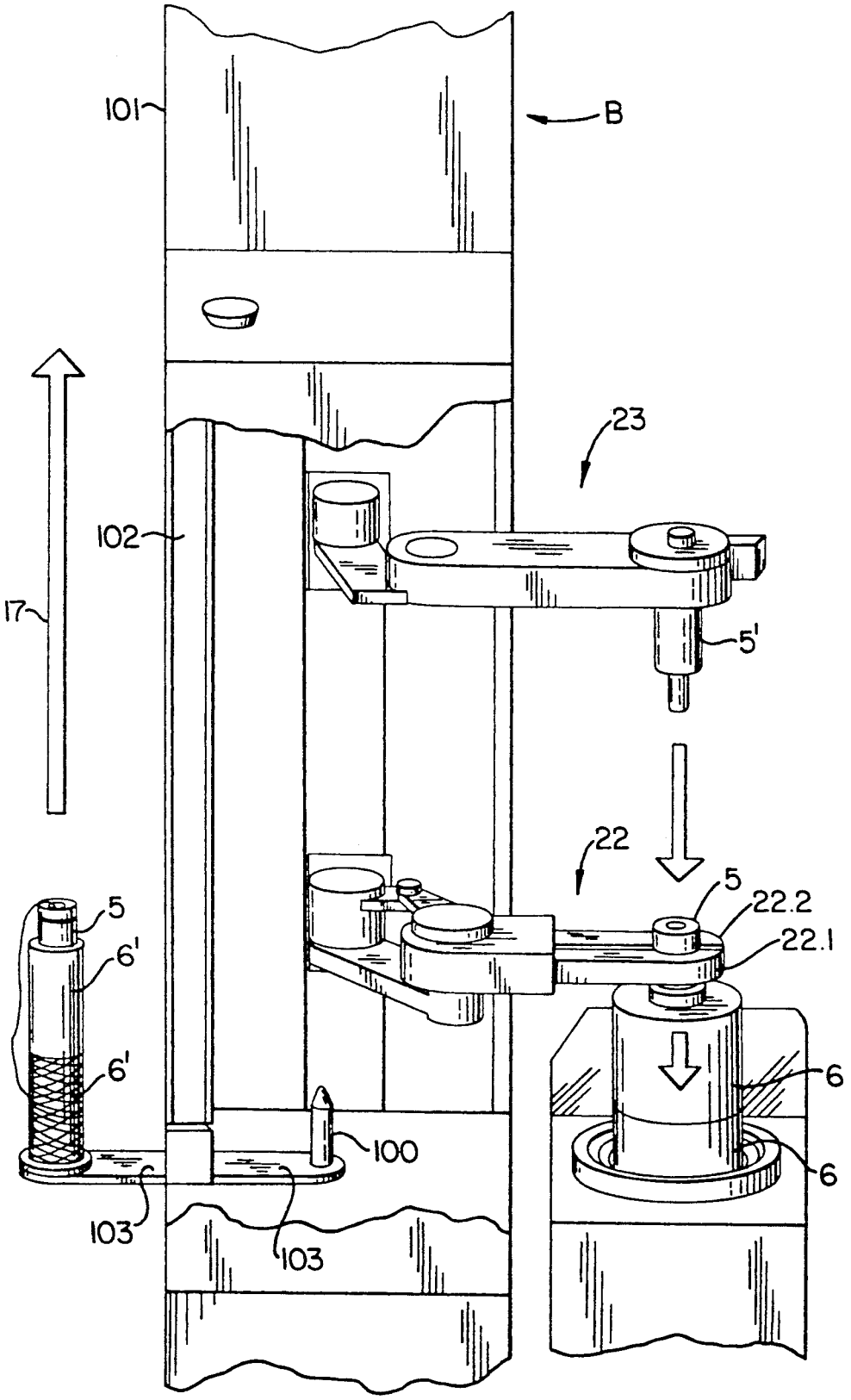
FIG. 4 is a perspective side view of a part of the automatic maintenance device with a means for replacing unwound tubes with fully wound packages and a pivoting and lifting means for replacing empty tubes with fully wound feed yarn packages.

FIG. 4 illustrates a condition, in which a package and transport adapter 5 holding fully wound feed yarn packages 6 is lowered into a spindle or its protective pot. This adapter 5 loaded with full feed yarn packages 6 was previously removed from the mandrel 100 located inside the automatic maintenance device Further shown in FIG. 4 and outside the automatic maintenance device B, is a package and transport adapter 5 holding the two empty or almost empty tubes 6'. This package adapter outside the automatic maintenance device B moves upward in direction of arrow f7 to the region of the overhead conveyor C, so as to deliver the unwound unit, comprising the package adapter 5 and two empty tubes 6', to an empty suspension holder 4 for its removal.

In the illustrated embodiment, two crosswound packages each are loaded on a package or transport adapter 5. As is known, when this stack of packages is fed to a two-for-one twisting spindle, the yarns are plied as they unwind on the twisting spindle. Likewise however, it is possible to load one assembly wound package on the package or transport adapter. Although in the present embodiment, the operating method of the apparatus of the present invention is described with reference to two cross-wound packages each carrying a single yarn, it is possible to proceed instead also from assembly wound packages, inasmuch as the handling of packages wound with a single yarn does not differ from packages wound with a plied yarn.

During the operating steps, as are shown in particular in FIG. 3, such as the grasping of an adapter 5 holding two empty or almost empty tubes 6' and, if necessary, the raising of the upper adapter portion 5' from the lower adapter portion 5, the swivel and lifting device 99 likewise integrated in the automatic maintenance device B disengages a full stack of packages (transport adapter 5 with full packages 6) from the overhead conveyor and transports same to the lower region of the automat B. At the same time, the suction device 23 with the upper gripper 37 and the upper adapter portion 5' held by the latter, swings back into the automat, so that the lower gripper 22 is able to lift the lower adapter portion 5 including the unwound tubes 6' out of the protective spindle pot and to swing same likewise into the automat. The unwound stack of packages is inserted by this lower gripper 22 on the mandrel 100 inside the automatic maintenance device B. This condition is shown in FIG. 6.

Figure 6:
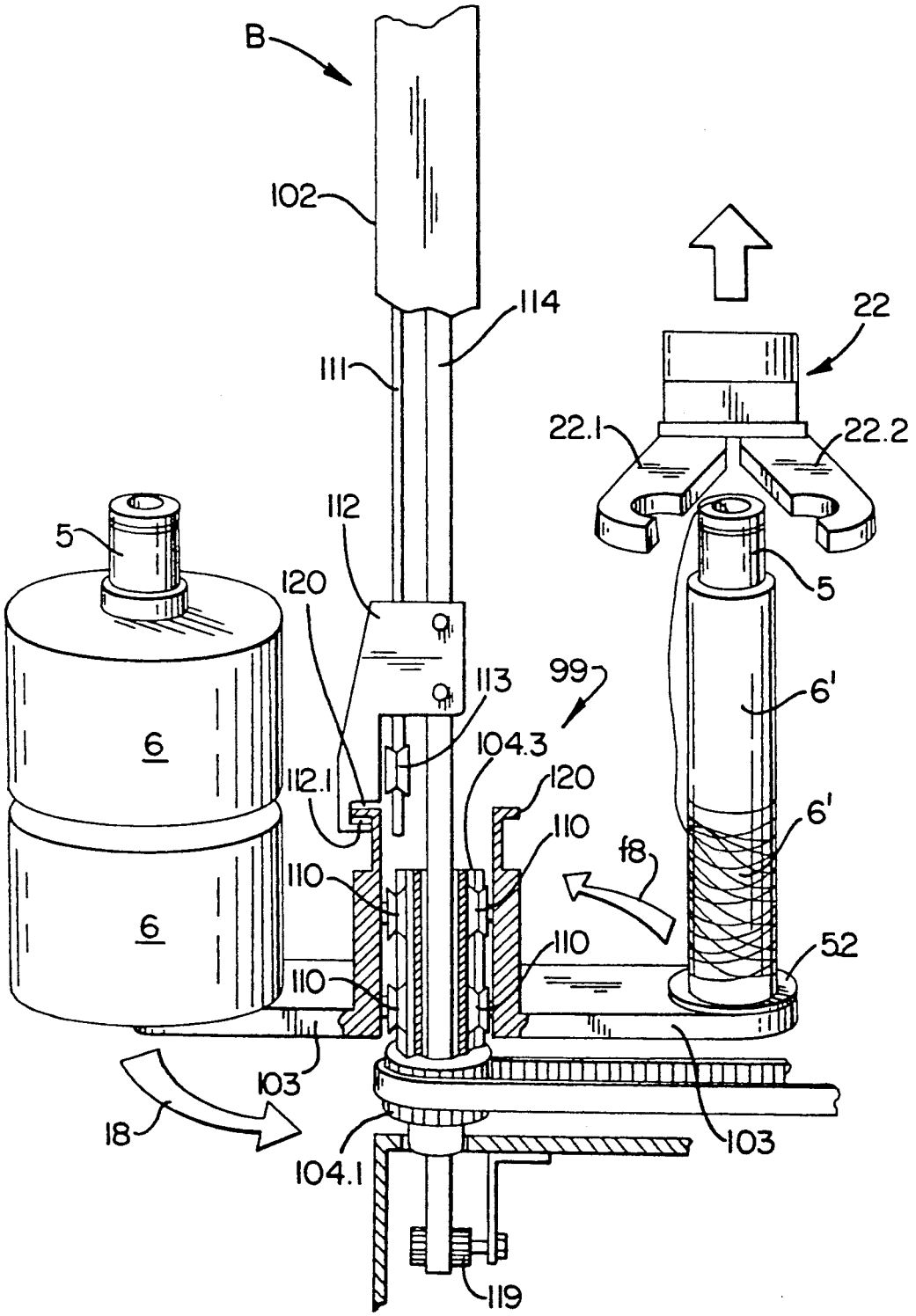
FIG. 6 is a partially sectional side view of the pivoting and lifting conveyor.

According to FIG. 6, the two swivel arms 103 assume their lowest position with their receiving mandrels 100 not shown in FIG. 6, with one of the swivel arms 103 carrying a feed yarn unit (package adapter 5 with full packages 6) being located outside the automatic maintenance device B, whereas the other swivel arm 103, whose mandrel received from gripper 22 an unwound unit (package adapter 5 with empty tubes 6'), is inside the automatic maintenance device B. By the rotation of the two arms 103 in direction of arrows f8, the swivel arms reach the position shown in FIG. 4, so that now the gripper 22 is able to grasp a full feed yarn unit 5, 6, 6 and to insert same into the protective spindle pot, while an empty unwound unit 5, 6', 6' can b moved upward for the purpose of delivering the package adapter 5 to the overhead conveyor C.

In the region of its swivel portion, the swivel and lifting device 99 is provided with a rotary head 104, which comprises both a drive pulley 104.1 and a hub portion 104.2. The rotary head 104, which is provided with a continuous axial opening, is put into rotation by means of an electric motor 105. This electric motor 105 drives a plate Cam 106, Which always effects a movement of the rotary head 104 by 90 and 180° respectively, via a lever mechanism 107 and a horizontal toothed belt 109, which is driven from the lever end and extends around drive pulley 104.1 and a drive pinion 108. The position of the rotary head 104 shown in FIG. 5 corresponds to the position of FIG. 1 and, thus, to the traveling condition of the automatic maintenance device B, with the two swivel arms 103 supported on the rotary head and, thus, also the mandrels 100, extending in a plane parallel to the traveling direction of the automatic maintenance device.

In the region of its hub portion, the rotary head 104 is provided with diametrically opposed guide rail sections 104.3, which serve to position and guide the swivel arms 103. To this end, each swivel arm 103 is provided with inwardly directed pairs of track rolls 110 in the region of a vertical leg 103.1, which are held by the guide rail sections 104.3, on the one hand, and which are adapted to roll in vertical direction along these guide rail sections 104.3, on the other hand.

The hoist element of the swivel and lifting device 99 is constructed in the fashion of a vertical elevator and comprises, beside a drive mechanism, a stationary vertical rail 111 inside the automatic maintenance device B, whose profile corresponds to that of the guide rail sections 104.3. A tow carriage 112 is able to move upward and downward in vertical direction along this vertical rail 111 by means of pairs of track rolls 113 guided along this vertical rail 111. This tow carriage 112 is attached to a hoist belt 114, which has a strand extending parallel to the vertical rail 111 in such a manner that the upward and downward movement of the hoist belt 114 allows to move the tow carriage 112 along the Vertical rail 111. In the illustrated embodiment, the hoist belt 114 is a toothed belt, which is guided over pinions 119.

For the drive of the hoist belt 114 a lifting cylinder 115 is used, which accommodates in its interior a lifting piston not shown. Attached to the latter is a plate 116 laterally extending from the lifting cylinder 115. Mounted on this plate are deflecting pulleys 117, vertically spaced apart and one on top of the other, which are constructed as pinions, and about which the end sections of the hoist belt 114 are looped, while the ends of the hoist belt are attached to holders 118. The hoist belt 114 loops about the deflecting pulleys in the fashion of a tackle such that one lifting motion a of the plate 116 corresponds to the double lifting motion **2*a* of the tow carriage 112 attached to the hoisting belt 114**.

The tow carriage 112 is provided with an inwardly directed, laterally open undercut 112.1, which is adapted to receive from the side, at a corresponding height of the tow carriage 112, an outwardly directed claw 120 arranged on the upper end of the vertical leg 103.1 of swivel arm 103. It is within the scope of the present invention to design and construct the coupling elements on the tow carriage 112 and on the swivel arms also in a different manner, as long as it is ensured that an engagement between the tow carriage 112 and the respective swivel arm can be provided, when one of the two guide rail sections 104.3 of the rotary head 104 is aligned with the vertical rail 111, so that with the upward movement of the tow carriage 112, the corresponding swivel arm 103 is removed upward from its guide rail section 104.3 and transferred to the region of the Vertical rail 111.

Figure 5:
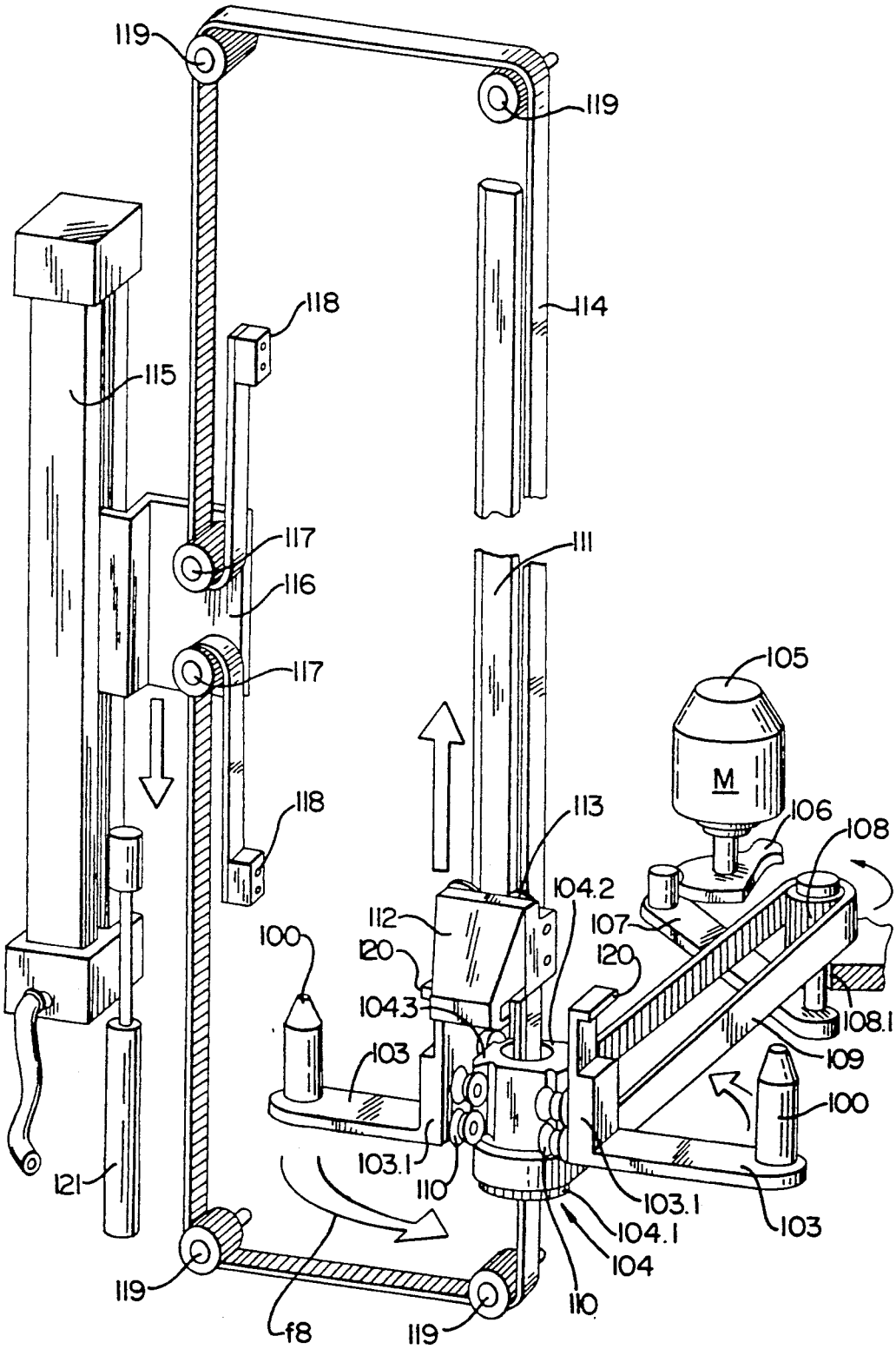
FIG. 5 is a schematic, perspective view of a pivoting and lifting conveyor.

The coupling elements between the tow carriage 112 and the individual swivel arms 103 are shown in a disengaged position in FIG. 5. FIG. 6 shows the one swivel arm 103 in an engaged position, in which the claw 120 engages in the undercut 112.1 of the tow carriage 112. The claw 120 and the undercut 112.1 are designed and constructed in such a manner that, as the tow carriage 112 is lowered, the claw 120 is able to enter laterally into the undercut 112.1, when the head 104 is rotated.

According to FIGS. 5 and 6, the aforesaid central opening extending through the rotary head 104 serves for the passage of the hoist belt 114. As soon as the one swivel arm 103 is engaged with the tow carriage 112, the former can be carried along upwardly by the tow carriage 112 during its upward movement, so as to transport upwardly an unwound unit inserted on the mandrel of this swivel arm 103 and to deliver same to the overhead conveyor.

The individual servicing and handling elements of the automatic maintenance device B perform motions in the following sequence:

While the grippers 22 and 37 rotate from the automatic maintenance device to a position coaxial with the spindle axis, and while, according to FIG. 3, the upper adapter portion 5' is separated from the lower adapter portion 5, a stack of full packages is removed by the hoisting device from the overhead conveyor and transported to the lower region of the automat. During the same time, the upper gripper 37 with the upper adapter portion 5' is rotated back into the automat, and the lower gripper having then removed the lower adapter portion 5 including the unwound tubes 6' from the protective spindle pot, is likewise rotated back into the automat, in which this unwound unit is inserted on the mandrel 100 inside the automat. At this time, the two swivel arms 103 are held in position on the rotary head 104, so that a subsequent rotation of the head by 180° causes the swivel arms 103 to interchange their positions. In so doing, the swivel arm 103 carrying the unwound unit 5, 6', 6' engages with the tow carriage 112, so that this swivel arm 103 is able to move upward for the purpose of delivering the unwound unit to the overhead conveyor, while at the same time the feed yarn unit 5, 6, 6 is lifted from the swivel arm 103 inside the automat and can be inserted into the protective spindle pot. Subsequently, the upper gripper 37 inserts the upper adapter portion 5' on the lower adapter portion 5.

The apparatus of the present invention further comprises a pneumatic or hydraulic dampening unit 121 in the region of the lifting cylinder 115, so as to cushion the upward and downward movements of the piston or respectively plate 116 of the lifting cylinder 115 in the region of it end points. The lifting cylinder 115 operates against the force of the dampening unit 121, so that the lifting motions are braked, thereby enabling a smooth entry of the tow carriage and the swivel arm 103 engaged therewith into the end positions. This procedure applies to both the disengagement of a feed yarn unit comprising fully wound packages 6 from the overhead conveyor and the engagement of an unwound unit in the overhead conveyor as well as to the entry of the swivel arms 103 into their end position on the rotary head 104.

I claim:

1. In a two-for-one twister textile yarn processing machine having a plurality of spindle assembly stations in side-by-side relationship along the length of the machine for processing of yarn at each station as the yarn is fed from yarn supply packages carried by an adapter device and mounted in the spindle assembly, and an overhead conveyor mechanism extending the length of the machine generally above the spindle assembly stations and including spaced-apart downwardly-directed suspension holders for releasably receiving and carrying adapter devices with full yarn supply packages thereon and adapter devices with substantially empty yarn supply packages thereon to and from respective spindle assembly stations; the improvement of a maintenance device means for traveling to a respective spindle assembly station, removing an adapter device with substantially empty yarn supply packages from the respective spindle assembly and positioning such adapter device on the conveyor mechanism, and synchronously removing an adapter device with full yarn supply packages from the conveyor mechanism and positioning such adapter device in the respective spindle assembly, said maintenance device means including:

a housing mounted for movement longitudinally along said machine to each of said spindle assembly stations, first gripper means mounted in said housing for upward, downward and pivoting horizontal movement for moving out of said housing and gripping the adapter device mounted in a spindle assembly at a selected station and moving and depositing such adapter device in said maintenance device means, and for gripping an adapter device with full yarn packages in said maintenance device means and moving and depositing such adapter device in the selected spindle assembly, and mandrel means including two horizontally-spaced upwardly-extending mandrels each mounted in said housing for upward, downward and pivoting horizontal movement for receiving and supporting the adapter device with substantially empty yarn packages from said gripper means on one of said mandrels positioned within said housing and for pivoting outside of said housing and moving upwardly to deposit such adapter device on one of the suspension holders of the conveyor mechanism and returning to the position within said housing, and for receiving and supporting an adapter device with full yarn packages from a suspension holder of the conveyor mechanism on the other of said mandrels after pivoting out of said housing and moving upward to the conveyor mechanism and returning to a position within said housing for gripping of the adapter device with full yarn packages by said gripper means, said mandrel means further includes a head device mounted for rotation about a horizontal axis in said housing, motor means for selectively driving said rotary head device, two separate arms each mounting one of said mandrels on the outer end thereof and being releasably carried by said rotary head device at their inner ends for rotation of said mandrels therewith out of and into said housing, and lifting means positioned for engaging one of said arms when said arm positions said mandrel carried thereby outside of said housing and for upward and downward movement of such arm and mandrel, said lifting means includes a vertical rail, a tow carriage device having track rolls thereon for moving up and down said rail, and a driven belt attached to said tow carriage device and extending generally parallel and along the length of said vertical rail, said rotary head device is provided with diametrically-opposed vertically-extending guide rail sections, and in which each of said mandrel carrying arms includes track rolls thereon for mounting of said arms on said rotary head device, said guide rail sections and said vertical rail being complimentary so that each of said arms may move in a vertical direction from said guide rail section to said vertical rail and up said vertical rail when lifted by said tow carriage of said lifting means.

2. In a two-for-one twister textile yarn processing machine, as set forth in claim 1, in which the adapter device for carrying yarn supply packages comprises a lower yarn package carrying part and an upper head piece part releasably and axially connected to each other, and in which said maintenance device means further includes second gripper means mounted in said housing for upward, downward and pivoting horizontal movement for moving out of said housing and gripping the upper part of the adapter device and removing the upper part of the adapter device for gripping and moving of the lower part of the adapter device with substantially empty yarn packages thereon by said first gripper means and for repositioning the upper part of the adapter device into the lower part of an adapter device with full yarn packages thereon after being positioned in the spindle assembly by said first gripper means.

3. In a two-for-one twister textile yarn processing machine, as set forth in claim 1, in which each of said mandrel carrying arms and said tow carriage device includes complimentary coupling elements so as to detachably couple one of said arms with said tow carriage device when rotated to position said mandrel carried thereby outside of said housing.

4. In a two-for-one twister textile yarn processing machine, a set forth in claim 3, in which said coupling elements comprise an undercut in said tow carriage device and a claw on each of said arms.

5. In a two-for-one twister textile yarn processing machine, as set forth in claim 1, in which said lifting means further includes drive means for said belt comprising a fluid operated piston and cylinder mechanism, a plate connected to said piston and cylinder mechanism for movement thereby in an upward and downward direction, two rotatable deflecting pulleys mounted on said plate for receiving opposite end sections of said belt looped there around in the form of a tackle, the ends of said belt being secured stationary on said housing so that upward and downward movement of said plate by said piston and cylinder causes movement of said belt to effect upward and downward movement on said tow carriage device.

6. In a two-for-one twister textile yarn processing machine, as set forth in claim 5, in which said belt is a toothed belt and said lifting means further includes pinion rolls over which said belt is mounted for guiding of said belt.

7. In a two-for-one twister textile yarn processing machine, as set forth in claim 6, in which said lifting means further includes dampening means associated with said piston and cylinder mechanism and said plate for a resilient braking of the movement of said plate and thus said belt.

* * * * *

UNITED STATES PATENT AND TRADEMARK OFFICE

CERTIFICATE OF CORRECTION

PATENT NO. : 5,119,621

DATED : June 9, 1992

INVENTOR(S) : Siegfried Inger

It is certified that error appears in the above-identified patent and that said Letters Patent is hereby corrected as shown below:

At column 1, line 18, delete "releasable" and substitute --releasably-- therefore.

At column 2, line 67, delete "two" and substitute --tow-- therefore.

At column 3, line 1, delete "two" and substitute --tow-- therefore.

At column 3, line 8, delete "rotatably" and substitute --rotatable-- therefore.

At column 3, line 15, delete "two" and substitute --tow-- therefore.

At column 3, line 41, after "elements" delete --,--

At column 3, line 66, delete "$" and substitute --5-- therefore.

At column 4, line 34, delete "Cross-wound" and substitute --cross-wound-- therefore.

At column 4, line 54, delete "crosswound" and substitute --cross-wound-- therefore.

At column 4, line 57, delete "6," and substitute --6'.-- therefore.

At column 5, line 45, delete "5," and substitute --5'-- therefore.

UNITED STATES PATENT AND TRADEMARK OFFICE

CERTIFICATE OF CORRECTION

PATENT NO. : 5,119,621

DATED : June 9, 1992

INVENTOR(S) : Siegfried Inger

It is certified that error appears in the above-indentified patent and that said Letters Patent is hereby corrected as shown below:

At column 6, line 34, delete "Which" and substitute --which-- therefore.

At column 6, line 61, delete "$" and substitute --5-- therefore.

At column 7, line 7, delete "crosswound" and substitute --corss-wound-- therefore.

At column 7, line 53, delete "b" and substitute --be-- therefore.

At column 7, line 62, delete "Which" and substitute --which-- therefore.

At column 7, lind 63, delete "90" and substitute --90°-- therefore.

At column 8, line 27, delete "Vertical" and substitute --vertical-- therefore.

UNITED STATES PATENT AND TRADEMARK OFFICE

CERTIFICATE OF CORRECTION

PATENT NO. : 5,119,621

DATED : June 9, 1992

INVENTOR(S) : Siegfried Inger

It is certified that error appears in the above-indentified patent and that said Letters Patent is hereby corrected as shown below:

At column 8, line 59, delete "Vertical" and substitute --vertical-- therefore.

Signed and Sealed this

Seventh Day of September, 1993

Bruce Lehman

*Attest:*

BRUCE LEHMAN

*Attesting Officer*

*Commissioner of Patents and Trademarks*